US006018133A

United States Patent [19]

Thuries

[11] Patent Number: 6,018,133

[45] Date of Patent: Jan. 25, 2000

[54] LOW-COMPRESSION PUFFER CIRCUIT-BREAKER

[75] Inventor: Edmond Thuries, Meyzieu, France

[73] Assignee: GEC Alsthom T & D SA, Paris, France

[21] Appl. No.: 09/131,673

[22] Filed: Aug. 10, 1998

[30] Foreign Application Priority Data

Aug. 11, 1997 [FR] France ..... 97 10 260

[51] Int. Cl.[7] ..... H01H 33/18; H01H 33/70; H01H 33/82

[52] U.S. Cl. ..... 218/43; 218/78; 218/154

[58] Field of Search ..... 218/43, 45, 46, 218/48, 50, 51, 56, 65, 72, 73, 78, 84, 154, 71–76, 60–66

[56] References Cited

U.S. PATENT DOCUMENTS

| | | | |
|---|---|---|---|
| 3,939,317 | 2/1976 | Noack et al. . | |
| 4,015,095 | 3/1977 | Bitsch et al. | 218/43 |
| 5,780,799 | 7/1998 | David | 218/57 |
| 5,859,399 | 1/1999 | Perret | 218/43 |

FOREIGN PATENT DOCUMENTS 0061992 10/1982 European Pat. Off. .

0667633 A1 8/1995 European Pat. Off. .

*Primary Examiner*—Lincoln Donovan

*Attorney, Agent, or Firm*—Sughrue, Mion, Zinn Macpeak & Seas, PLLC

[57] ABSTRACT

A circuit-breaker of the puffer type, comprising two arcing contacts, at least one of the arcing contacts being part of a moving contact assembly made up of a first tube co-operating with a second tube to define a blast chamber, and a compression chamber closed by a semi-moving piston, the circuit-breaker being provided with first means for holding the piston stationary during a first portion of the displacement stroke of the moving contact assembly between the closed position and the open position, and with second means for displacing the piston axially with the moving contact assembly during a second portion of the same displacement stroke. The first means for holding the piston stationary comprise a stationary retaining member for locking an abutment arrangement associated with the piston, and the second means for axially displacing the piston comprise an unlocking member for unlocking said abutment arrangement, which member is associated with the moving contact assembly.

8 Claims, 2 Drawing Sheets

LOW-COMPRESSION PUFFER CIRCUIT-BREAKER

The present invention relates to a low-compression puffer circuit-breaker, and in particular to a high-voltage low-compression puffer circuit-breaker.

BACKGROUND OF THE INVENTION

Document FR-2 715 499 discloses a puffer-type circuit-breaker comprising a casing filled with a dielectric gas under pressure, and two arcing contacts co-operating with each other, at least one of the arcing contacts being part of a moving contact assembly secured to a drive member and organized to be displaced axially inside the casing between a closed position and an open position on being driven during an opening operation, the moving contact assembly being made up of a first tube co-operating with a second tube that is coaxial with the first tube to define firstly a blast chamber on one e of a ring connected both to the first tube and to the second tube, and secondly a compression chamber on the other side of the ring, communicating with the blast chamber, and closed by a semi-moving piston, the circuit-breaker being provided with first means for holding the piston stationary during a first portion of the displacement stroke of the moving contact assembly between the closed position and the open position, and with second means for displacing the piston axially with the moving contact assembly during a second portion of the same displacement stroke of the moving contact assembly.

When low currents are to be interrupted, the arc that strikes between the arcing contacts during an opening operation is extinguished by means of the gas in the compression chamber being compressed. The flow of gas coming from the compression chamber extinguishes the arc before the end of the displacement stroke of the moving assembly. Therefore, it is not necessary to compress the gas in the compression chamber during the entire displacement stroke of the moving contact assembly. Once the piston starts moving with the moving assembly, the quantity of energy required to drive the moving contact assembly is very small because the gas is no longer compressed.

As disclosed in that prior document, the means comprise pneumatic means co-operating with mechanical means.

In a preferred embodiment described in that prior document, the second mechanical means for displacing the piston axially comprise an entrainment member associated with the moving contact assembly, which member entrains an abutment element, associated with the piston, during the second portion of the displacement stroke of the moving contact assembly, the abutment assembly being disposed in the path of the entrainment member. The first mechanical means for holding the piston stationary comprise a spring disposed between a stationary element and an end wall of the piston and a stationary retaining member that co-operates with an abutment wall of the piston. The pneumatic means are means for generating suction in the space lying between the stationary retaining member and the abutment wall, which space is made leak-proof.

Such an arrangement is relatively complex, and is costly to manufacture.

SUMMARY OF THE INVENTION

An object of the invention is to provide a low-compression circuit-breaker that is)simpler and therefore less costly to manufacture, and that does not need a large amount of drive energy.

To this end, according to the invention, the first means for holding the piston stationary comprise a stationary retaining member for locking an abutment arrangement associated with the piston, and the second means for axially displacing the piston comprise an unlocking member for unlocking the abutment arrangement, which member is associated with the moving contact assembly.

In a preferred embodiment, the piston is constituted by an annular pressure element, and by a rear cylinder whose inside diameter is substantially equal to the outside diameter of the second tube over a length greater than the length of the first portion of the displacement stroke.

In a first variant, the abutment arrangement is constituted by at least one ball which is received in a slot provided in the rear cylinder, and which is of diameter greater than the thickness of the cylinder.

In a second variant, the abutment arrangement is constituted by at least one flexible blade secured at one of its ends to the rear cylinder, and carrying at its other end a collar-shaped element which is received in a slot provided in the rear cylinder and which is of radial thickness greater than the thickness of the cylinder.

Preferably, the retaining member is constituted by a stationary cylinder having one of its ends provided with a recess for receiving the abutment arrangement.

Preferably, the unlocking member is constituted by a smaller-diameter portion of the second tube in front of the length, i.e. closer to the contacts, the difference between the smaller diameter and the diameter of the length being such that the abutment member releases the recess in the retaining member once the moving contact assembly has travelled over the first portion of the displacement stroke.

BRIEF DESCRIPTION OF THE DRAWINGS

The invention is described in more detail below with reference to the accompanying figures which show a preferred embodiment of the invention, and in which.

DETAILED DESCRIPTION OF THE PREFERRED EMBODIMENTS

Figure 1:
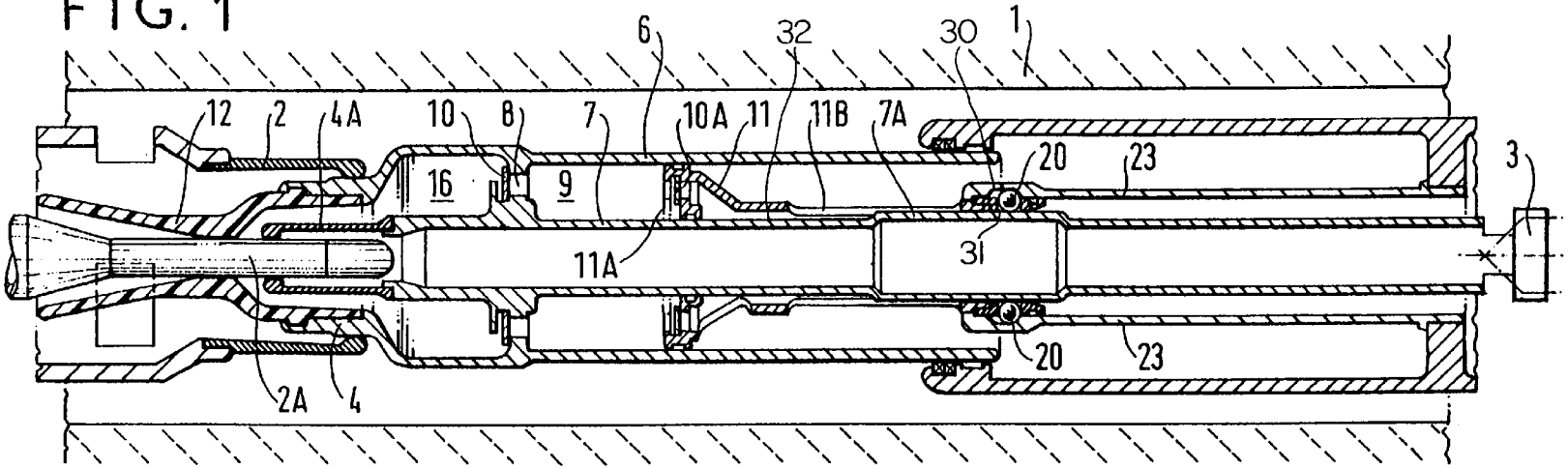
FIG. 1 is longitudinal section view of a first variant embodiment of a circuit-breaker of the invention, shown in the closed position.

The circuit-breaker of the puffer type shown in FIGS. 1 to 4 comprises a casing 1 filled with a dielectric gas under pressure, and two arcing contacts 2A, 4A co-operating with each other, at least one of the arcing contacts (4A) being part of a moving contact assembly secured to a drive member 3 and organized to be displaced axially inside the casing 1 between a closed position and an open position on being driven during an opening operation. The moving contact assembly is made up of a first tube 6 co-operating with a second tube 7 that is coaxial with the first tube to define firstly, a blast chamber 16 closed by a nozzle 12, on one side of a ring 8 connected both to the first tube 6 and to the second tube 7, and secondly, on the other side of said ring, a compression chamber 9 communicating with the blast chamber 16 and closed by a semi-moving piston 11 equipped with at least one check valve 22 preventing the gas from leaving the compression chamber 9. The ring 8 is provided with orifices equipped with check valves 10 enabling the gas to pass through from the compression chamber 9 to the blast chamber 16. The first tube 6 is mounted to slide on a stationary tube 3 by means of sliding contacts.

In conventional manner, the circuit-breaker further comprises permanent contacts 2, 4.

The circuit-breaker is provided with first means for holding the piston stationary during a first portion of the displacement stroke of the moving contact assembly between the closed position and the open position, and with second means for displacing the piston axially with the moving contact assembly during a second portion of the same displacement stroke of the moving contact assembly.

The first means for holding the piston stationary comprise a stationary retaining member for locking an abutment arrangement associated with the piston 11, and the second means for axially displacing the piston 11 comprise an unlocking member for unlocking said abutment arrangement, which member is associated with the moving contact assembly.

The piston 11 is constituted by an annular pressure element 11 constituting the face retaining the pressure, and equipped with said check valves 10A, and by a rear cylinder 11B (i.e. a cylinder remote from the contacts 2A, 4A). The rear cylinder 11B is of diameter that varies over its length, but it is of inside diameter substantially equal to the outside diameter of a portion 7A of the second tube 7, which portion is of length greater than said first portion of the displacement stroke.

The first means for holding the piston stationary thus comprise a stationary retaining member for locking an abutment arrangement associated with the piston 11.

Figure 2:
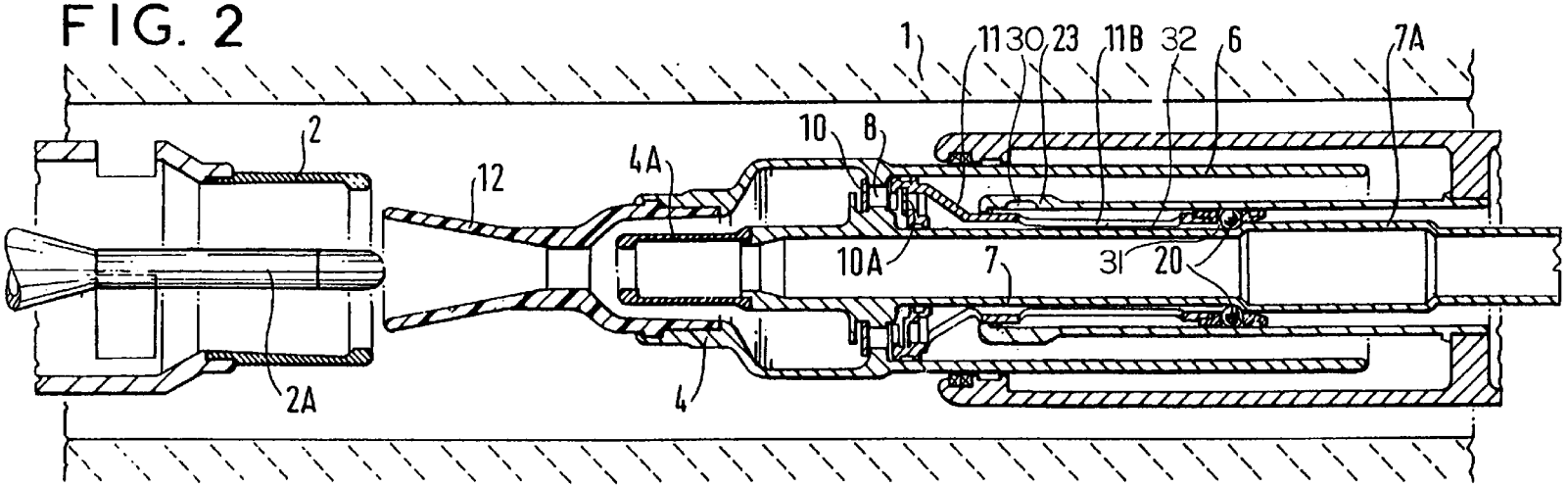
FIG. 2 is a longitudinal section view of the same circuit-breaker, shown in the open position.

In the first variant embodiment shown in FIGS. 1 and 2, the abutment arrangement is constituted by at least one ball 20 which is received in a slot 31 provided in said rear cylinder 11B and which is of diameter greater than the thickness of said cylinder 11B.

Figure 3:
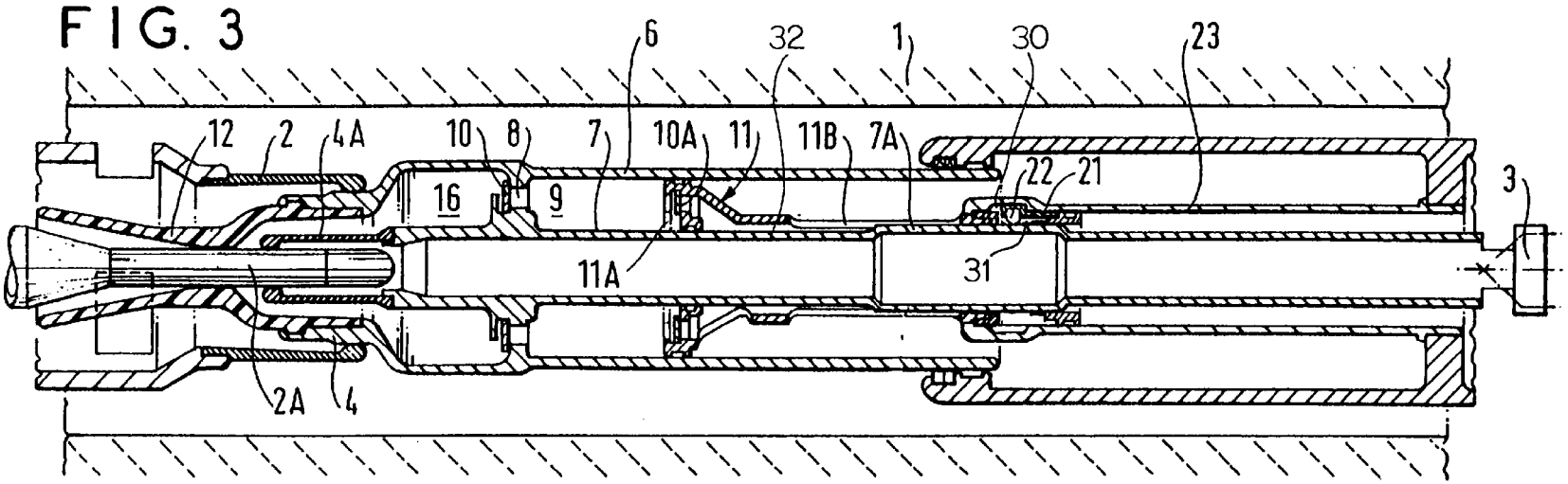
FIG. 3 is a longitudinal section view of a second variant embodiment of a circuit-breaker of the invention, shown in the closed position.
Figure 4:
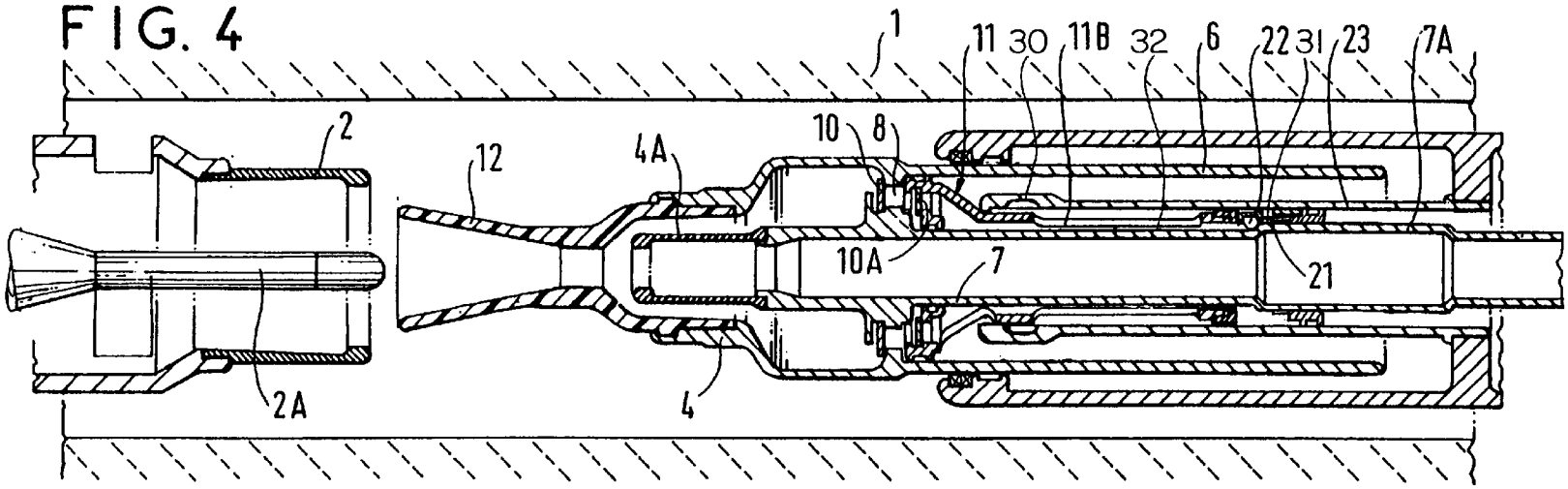
FIG. 4 is a longitudinal section view of the same circuit-breaker, shown in the open position.

In the second variant shown in FIGS. 3 and 4, the abutment arrangement is constituted by at least one flexible blade 21 having one of its ends secured to said rear cylinder 11B, and carrying, at its other end, a collar-shaped element 22 which is received in a slot 31 provided in said rear cylinder 11B and which is of radial thickness greater than the thickness of said cylinder 11B.

In both variants, the retaining member 23 is constituted by a stationary cylinder provided at one of its ends with a recess 30 for receiving said abutment arrangement.

The second means for axially displacing the piston 11 thus comprise a member for unlocking said abutment arrangement, which member is associated with the moving contact assembly.

In both variants, the unlocking member is constituted by a portion 32 of the second tube 7 that has a smaller diameter than the portion 7A, and that is situated in front of said portion 7A, i.e. closer to the contacts. The difference between the diameter of the smaller-diameter portion 32 and the diameter of the portion 7A is such that the abutment member releases said recess 30 in the retaining member 23 once the moving contact assembly has travelled over said first portion of the displacement stroke, i.e. over the compression stroke.

The functions of the various parts are explained below by describing an opening operation in which the circuit-breaker is opened.

In FIGS. 1 and 3, the circuit-breaker is shown in the closed position.

The arcing contacts 2A and 4A are in the fully interfitted position, and the piston 11 is held in the stationary position, its annular element 11A co-operating with the ring 8 to define a compression volume 9 that is at its maximum.

In this position, that end of the rear cylinder 11B which carries the abutment member (either the balls 20 or the blades 21 provided with their collars 22) is situated on the larger-diameter portion 7A, and each of the balls 20 or the collars 22, which are in contact with said portion 7A, projects from its slot 31 away from the second tube 7 and is received by the recess 30 in the retaining member 23.

During the opening operation, the moving contact assembly is displaced (rightwards as shown in the figures), and so long as the abutment member (balls 20 or collars 22) rolls or slides over the portion 7A, it is locked by the retaining member 23 and the piston 11 is thus held stationary.

The end of the compression stroke, i.e. the changeover to the second portion of the displacement stroke in which the piston 11 is displaced axially with the moving contact assembly, is reached when the abutment member (balls 20 or collars 22) is situated outside said portion 7A, in the position shown in FIGS. 2 and 4.

The abutment element (balls 20 or collars 22) can then be displaced towards the smaller-diameter portion 32 of the tube 7, thereby releasing the recess 30 in the retaining member 23 which then no longer locks the piston 11 which, because of the pressure from the gas in the compression volume, is displaced with the moving contact assembly until it reaches the open position shown in FIGS. 2 or 4.

The arrangement may be improved, in particular in the first variant in which balls 20 are used, by putting a compression spring in place in the compression volume between the ring 8 and the piston 11 so as to urge each of the balls rearwards into abutment against the rear face only of the recess 30 in the retaining member 23, thereby avoiding any jamming of the balls 20.

I claim:

1. A circuit-breaker of the puffer type, comprising a casing filled with a dielectric gas under pressure, and two arcing contacts co-operating with each other, at least one of the arcing contacts being part of a moving contact assembly secured to a drive member and organized to be displaced axially inside the casing between a closed position and an open position on being driven during an opening operation, the moving contact assembly being made up of a first tube co-operating with a second tube that is coaxial with the first tube to define firstly a blast chamber, on one side of a ring connected both to the first tube and to the second tube, and secondly a compression chamber on the other side of said ring, communicating with the blast chamber, and closed by a semi-moving piston, the circuit-breaker being provided with first means for holding the piston stationary during a first portion of the displacement stroke of the moving contact assembly between the closed position and the open position, and with second means for displacing the piston axially with the moving contact assembly during a second portion of the same displacement stroke of the moving contact assembly, wherein the first means for holding the piston stationary comprise a stationary retaining member for locking an abutment arrangement associated with the piston, and the second means for axially displacing the piston comprise an unlocking unlacking member for unlocking said abutment arrangement, which member is associated with the moving contact assembly.

2. A circuit-breaker according to claim 1, wherein the piston is constituted by an annular pressure element, and by a rear cylinder whose inside diameter is substantially equal to the outside diameter of the second tube over a length greater than the length of said first portion of the displacement stroke.

3. A circuit-breaker according to claim 2, wherein the abutment arrangement is constituted by at least one ball which is received in a slot provided in said rear cylinder, and which is of diameter greater than the thickness of the cylinder.

4. A circuit-breaker according to claim 2, wherein the abutment arrangement is constituted by at least one flexible blade secured at one of its ends to said rear cylinder, and carrying at its other end a collar-shaped element which is received in a slot provided in said rear cylinder and which is of radial thickness greater than the thickness of said cylinder.

5. A circuit-breaker according to claim 3, wherein the retaining member is constituted by a stationary cylinder having one of its ends provided with a recess for receiving said abutment arrangement.

6. A circuit-breaker according to claim 2, wherein the unlocking member is constituted by a smaller-diameter portion of the second tube in front of said length, and closer to the contacts, the difference between the smaller diameter and the diameter of said length being such that the abutment member releases said recess in the retaining member once the moving contact assembly has travelled over said first portion of the displacement stroke.

7. A circuit breaker of the puffer type, comprising:

a casing filled with a dielectric gas under pressure, and two arcing contacts co-operating with each other, at least one of the arcing contacts being part of a moving contact assembly secured to a drive member and operative to be displaced axially inside the casing between a closed position and an open position on being driven during an opening operation, the moving contact assembly comprising:

a first tube outer tube co-operating with a second inner tube that is coaxial with the first tube to define firstly a blast chamber, on one side of a ring connected both to the first tube and to the second tube, and secondly a compression chamber on the other side of said ring, communicating with the blast chamber, and closed by a semi-moving piston, the circuit-breaker further comprising:

first means for holding the piston stationary during a first portion of the displacement stroke of the moving contact assembly between the closed position and the open position, and second means for displacing the piston axially with the moving contact assembly during a second portion of the same displacement stroke of the moving contact assembly, wherein the first means for holding the piston stationary comprise a stationary retaining member disposed coaxially between the first tube and the second tube, within which the second tube moves, for locking an abutment arrangement associated with the piston, and the second means for axially displacing the piston comprise an unlocking member for unlocking said abutment arrangement, which unlocking member is associated with the moving contact assembly.

8. A circuit breaker of the puffer type, comprising:

a casing filled with a dielectric gas under pressure, and two arcing contacts co-operating with each other, at least one of the arcing contacts being part of a moving contact assembly secured to a drive member and operative to be displaced axially inside the casing between a closed position and an open position on being driven during an opening operation, the moving contact assembly comprising:

a first tube outer tube co-operating with a second inner tube that is coaxial with the first tube to define firstly a blast chamber, on one side of a ring connected both to the first tube and to the second tube, and secondly a compression chamber on the other side of said ring, communicating with the blast chamber, and closed by a semi-moving piston, the circuit-breaker further comprising:

a retaining member coaxially disposed between said first and second tube, said retaining member having a recess at one end; and an abutment member disposed in a slot in the piston, said abutment member being received and locked in said recess of said retaining member to hold the piston stationary during a first portion of the displacement stroke of the moving contact assembly between the closed position and the open position;

wherein the second tube has a portion which has a reduced diameter such that when the second tube and the piston are axially displaced during a second portion of the same displacement stroke of the moving contact assembly, said abutment member is moved into a position within said reduced diameter portion of said second tube, thereby unlocking said abutment member from said recess.

* * * * *